US007785142B2

(12) United States Patent
Hardy et al.

(10) Patent No.: US 7,785,142 B2
(45) Date of Patent: Aug. 31, 2010

(54) PANEL MOUNTABLE CONNECTOR ASSEMBLY

(75) Inventors: Douglas John Hardy, Middletown, PA (US); John Wesley Hall, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 60 days.

(21) Appl. No.: 12/206,029

(22) Filed: Sep. 8, 2008

(65) Prior Publication Data

US 2010/0062634 A1 Mar. 11, 2010

(51) Int. Cl.
*H01R 9/05* (2006.01)

(52) U.S. Cl. ..... 439/578

(58) Field of Classification Search ..... 439/564, 439/954, 562, 565, 931, 97, 831, 578, 342
See application file for complete search history.

(56) References Cited

U.S. PATENT DOCUMENTS 5,104,333 A * 4/1992 Hatagishi et al. ..... 439/342
6,406,192 B1 * 6/2002 Chen et al. ..... 385/56
6,702,593 B2 * 3/2004 Ogawa ..... 439/79
6,702,611 B1 * 3/2004 Miyazaki et al. ..... 439/559
7,238,048 B2 * 7/2007 Olson et al. ..... 439/607.28
7,326,063 B1 * 2/2008 Raudenbush et al. ..... 439/63
2006/0170610 A1 8/2006 Rabinovich
2008/0020723 A1 1/2008 Rabinovich
2008/0188123 A1 8/2008 Hall

* cited by examiner

*Primary Examiner*—Jean F Duverne

(57) ABSTRACT

An RF connector assembly for mating to a mating connector securely attached to a device includes an inner conductor and an outer conductor coaxially aligned with one another. The inner and outer conductors define a mating interface for mating with the mating connector. The connector assembly also includes an outer body having a latching element configured to couple to the mating connector. The outer body also has a flange extending from the outer body and being configured to face the device when the coaxial connector assembly is mated with the mating connector. A fastener is separately provided from the outer body and engages the flange and the device to securely couple the outer body to the device. Optionally, the outer conductor may define the outer body. Alternatively, the outer body may be a plastic outer body that surrounds the outer conductor.

20 Claims, 10 Drawing Sheets

PANEL MOUNTABLE CONNECTOR ASSEMBLY

BACKGROUND OF THE INVENTION

The subject matter herein relates generally to connector assemblies, and more particularly to panel mounted connector assemblies.

Radio frequency (RF) connector assemblies have been used for numerous automotive applications, such as global positioning systems (GPS), car radios, mobile phones, air bag deployment systems, and multimedia devices. The connector assemblies are typically coaxial cable connectors that are provided at the end of coaxial cables. However, at least some known RF connector assemblies are directly mounted to circuit boards.

In order to standardize various types of connector assemblies, particularly the interfaces for such connector assemblies, certain industry standards have been established. One of these standards is referred to as FAKRA. FAKRA is the Automotive Standards Committee in the German Institute for Standardization, representing international standardization interests in the automotive field. The FAKRA standard provides a system, based on keying and color coding, for proper connector attachment. Like jack keys can only be connected to like plug keyways in FAKRA connectors. Secure positioning and locking of connector housings is facilitated by way of a FAKRA defined catch on the jack housing and a cooperating latch on the plug housing.

However, even with the catch and latch systems of the connector assemblies, problems, with maintaining a secure and reliable connection remain in known connector assemblies. For example, the connector assemblies may be used in harsh environments, such as in automotive environments, where the connector assemblies are subjected to vibrations arid other movements that strain the connection between the connector assemblies. The latch and catch systems have been known to fail and/or become unreliable. Additionally, in some applications, one of the connectors, typically the jack, may be permanently mounted to a panel, chassis, frame or other mounting structure of the automobile. Movement and vibration of the automobile is transferred directly to the connector mounted to the structure of the automobile, causing strain at the mating interface of the connectors.

A need remains for a connector assembly that may be securely mounted to a panel or other mounting structure in a cost effective and reliable manner. A heed remains for a connector assembly that provides a reliable connection between the connectors of the connector assembly.

BRIEF DESCRIPTION OF THE INVENTION

In one embodiment, an RF connector assembly for mating to a mating connector securely attached to a device is provided that includes an inner conductor and an outer conductor coaxially aligned with one another. The inner and outer conductors define a mating interface for mating with the mating connector. The connector assembly also includes an outer body having a latching element configured to couple to the mating connector. The outer body also has a flange extending from the outer body and being configured to face the device when the coaxial connector assembly is mated with the mating connector. A fastener is separately provided from the outer body and engages the flange and the device to securely couple the outer body to the device. Optionally, the outer conductor may define the outer body. Alternatively, the outer body may be a plastic outer body that surrounds the outer conductor.

Optionally, the fastener may be a screw having a head and threads where the head and/or the threads engage the flange and the threads engage the device. The device may include a panel having a front, rear and an elongated slot, the flange may include an opening and the fastener may include a hook extending from a front of the fastener, wherein the hook passes through the opening and the slot to engage the rear of the panel of the device when the fastener is moved to a locking position. The fastener may be held against the rear of the panel of the device and extend beyond the front of the panel of the device through the opening of the flange to engage the flange to couple the outer body to the device.

In another embodiment, an RF connector assembly is provided that includes a circuit board defining an RF antenna and a coaxial plug connector electrically arid mechanically coupled to the circuit board. The plug connector is matable with a coaxial jack connector that is securely attached to a device. The plug connector includes an outer body having a mating cavity configured to receive the jack connector along a mating axis. The outer body has a latching element, configured to couple to the jack connector and a flange extending from the outer body that includes an opening. The plug connector also includes a center contact received in the cavity that extends along the mating axis. The center contact has a mating end for mating with the jack connector and a mounting end coupled to the, circuit board. A fastener is received in the opening of the flange. The fastener engages the device to securely couple the outer body to the device.

In a further embodiment, an RF connector system for a device is provided that includes a jack connector, a plug connector and a fastener. The jack connector is configured to be mounted internally within the device proximate to a port in a panel of the device. The jack connector has an inner conductor and an outer conductor coaxially aligned with one another, where the inner and outer conductors define a mating interface. The jack connector has a latching element. The plug connector has a center contact coupled to the inner conductor of the jack connector. The plug connector has an outer body including a latching element configured to latch to the latching element of the jack connector. The outer body includes a flange extending from the outer body. The fastener engages the flange arid the panel of the device proximate to the port to securely couple the outer body to the device.

DETAILED DESCRIPTION OF THE INVENTION

Figure 1:
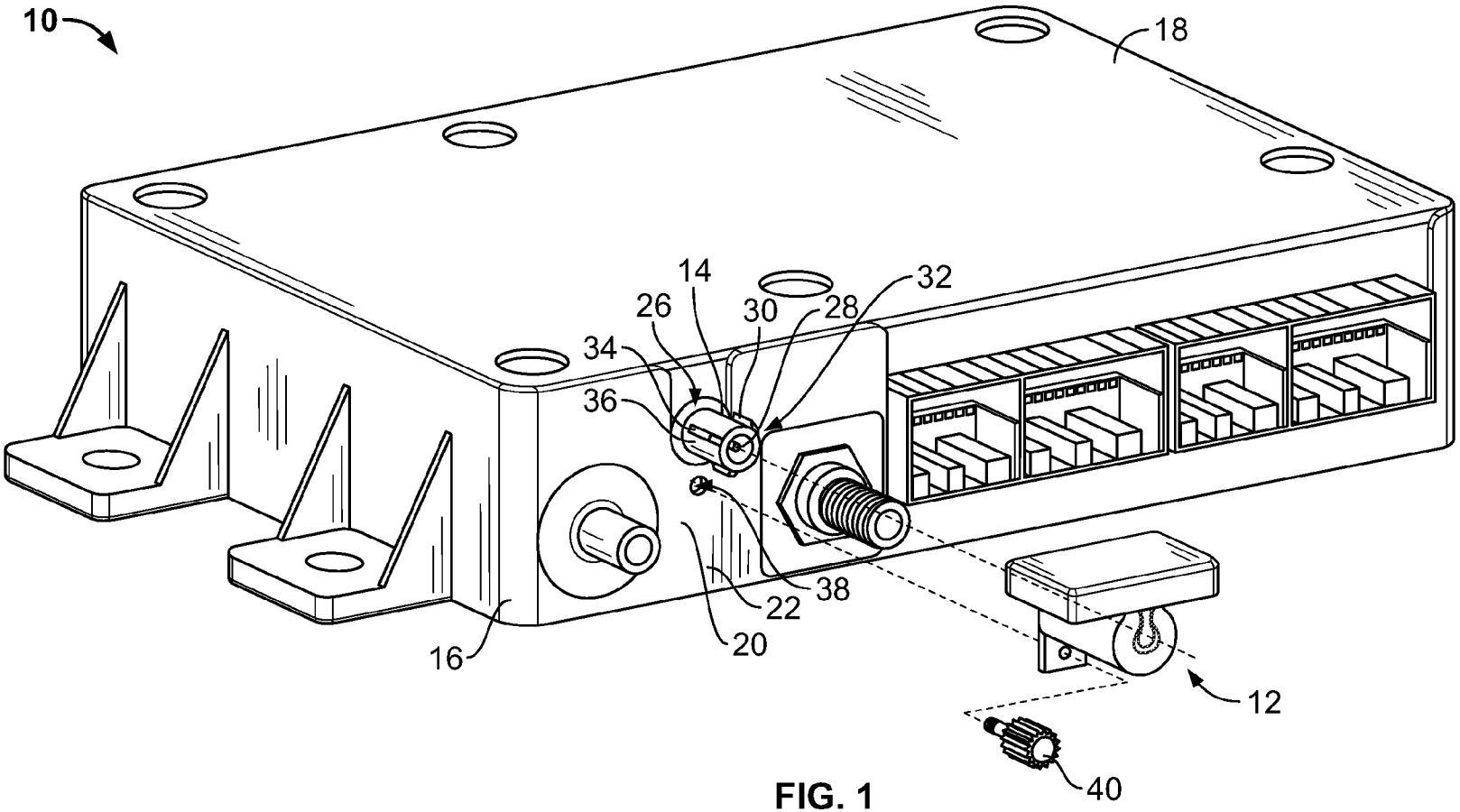
FIG. 1 illustrates a system utilizing a connector assembly formed in accordance with an exemplary embodiment.

FIG. 1 illustrates a system 10 utilizing a connector assembly 12 formed in accordance with an exemplary embodiment. In the illustrated embodiment, the system 10 is a communications system, such as for an automotive vehicle, and the connector assembly 12 is an RF plug connector, such as for use as an RF antenna assembly. While FIG. 1 illustrates the system 10 as a communication system and the connector assembly 12 as an RF antenna, the subject matter herein is not limited to such systems and components. The system 10 and connector assembly 12 are merely illustrative and are not limited to the embodiments illustrated herein.

The connector assembly 12 is coupled to a mating connector 14 of a device 16. The connector assembly 12 is also secured directly to the device 16 in addition to being, secured to the mating connector 14. In an exemplary embodiment, the mating connector 14 defines a subminiature B (SMB) jack connector with a FAKRA mating interface and the connector assembly 12 defines an SMB plug connector with a FAKRA mating interface. While FIG. 1 illustrates the mating connector 14 as a FAKRA-like jack connector and the connector assembly 12 as a FAKRA-like plug connector, the subject matter herein is not limited to connectors meeting the FAKRA standard. The plug and jack connectors are merely illustrative and are not limited to the embodiments illustrated herein.

The device 16 includes a housing 18 having a plurality of panels 20. The panels 20 have a front 22 and a rear opposite to the front 22 that define an exterior and an interior, respectively, of the device 16. In alternative embodiments, rather than being mounted to the device panels 20, the connector assembly 12 may be mounted to a, different mounting structure, such as a wall, chassis, frame, or other mounting structure depending on the application or system. The mating connector 14 is mounted to, or otherwise attached to, the interior of the device 16. Optionally, the mating connector 14 may be mounted to one of the panels 20, however me mating connector may be attached to another structure of the device 16 designated for supporting the mating connector 14. The mating connector 14 may be either board mounted or cable mounted in different applications. Optionally, the mating connector 14 may define a coaxial, RF connector. In the illustrated embodiment, at least a portion of the mating connector 14 extends through a port 26 of the panel 20 and is exposed to the exterior of the device 16. Optionally, the entire mating connector 14 may be housed within the interior of the device 16 behind the rear of the panel 20. The port 26 provides an opening through which the mating connector 14 extends to mate with the connector assembly 12.

The mating connector 14 includes an inner conductor 28 and an outer conductor 30 coaxially aligned with one another. The inner and outer conductors 28, 30 define a mating interface 32 of the mating connector 14. Optionally, the mating connector 14 includes at least one keying rib 34. The keying rib(s) 34 may be selectively positioned on the exterior of a mating portion 36 of the mating connector 14 to define the mating interface 32. Different mating connectors 14 may have keying ribs 34 in different positions to define different types of mating connectors 14.

The device 16 includes an opening 38. A fastener 40 is coupled to the connector assembly 12 and is received in the opening 38 to couple the connector assembly 12 to the device 16. Optionally, the opening 38 and the fastener 40 may be threaded. Other fastening means may be used to securely couple the connector assembly 12 to the device 16. By directly coupling the connector, assembly 12 to the device 16, the connection between the connector assembly 12 and the mating connector 14 may be maintained and/or reinforced.

Figure 2:
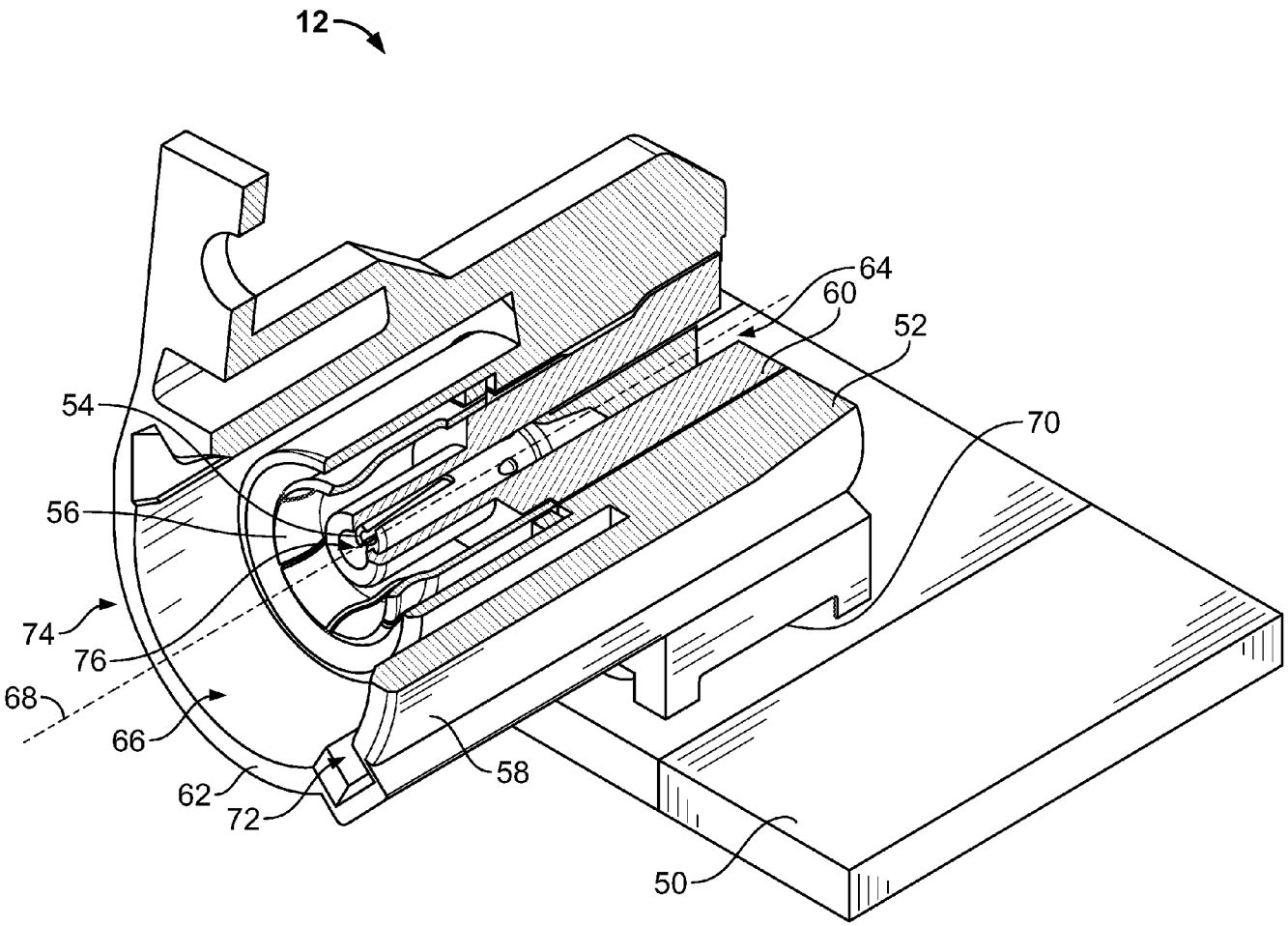
FIG. 2 is a partial cut-away view of the connector assembly shown in FIG. 1.

FIG. 2 is a partial cut-away view of the connector assembly 12. The connector assembly 12 includes a circuit board 50 and a plug connector 52 electrically and mechanically coupled to the circuit board 50. The circuit board 50 may be configured as an RF antenna. The plug connector 52 includes an inner conductor 54 and an outer conductor 56 coaxially aligned with, arid circumferentially surrounding, the inner conductor 54. The outer conductor 56 is fabricated from a die cast metal and forms an outer body 58 of the plug connector 52. In an alternative embodiment, the outer body 58 may be a plastic housing fit over the outer conductor 56. Alternatively, the outer conductor 56 may not be die cast, but is formed by another process or by another conductive material, such as screw machining, stamping and forming metal, metalizing a plastic body, applying a conductive coating to a plastic body, and the like. In an exemplary embodiment, the plug connector 52 also includes a dielectric body 60 separating the inner and outer conductors 54, 56 from one another.

The outer body 58 defines an outer envelope of the connector assembly 12. The outer body 58 includes a mating end 62 at a front of the outer body 58 and a rear end 64 generally opposite to the mating end 62. Optionally, the rear end 64 is open for loading the inner conductor 54 and/or the dielectric body 60 into the outer body 58. The outer body 58 includes a mating cavity 66 extending along a mating axis 68. Optionally, the mating axis 68 may define a central axis of the mating cavity 66. The outer body 58 includes a base 70 coupled to the circuit board 50. The outer body 58 includes at least one keying slot 72 open at the mating end 62 for keyed or polarizing mating with the mating connector 14 (shown in FIG. 1). The keying slot 72 receives the keying rib 34 (shown in FIG. 1) of the mating connector 14. Features of the outer body 58 may be sized, shaped and positioned to comply with standards, such as the FAKRA standard. For example, the mating cavity 66 and the keying slot 72 may define a mating interface 74 at the mating end 62 that have certain dimensions and locations.

The inner conductor 54 and the dielectric body 60 are loaded into the mating cavity 66 through the rear end 64. The inner conductor 54 defines a center contact extending along the mating axis 68. The inner conductor 54 has a mating end 76 and a mounting end (riot shown) that is coupled to the circuit board 50. Optionally, the mounting end may be surface mounted or through hole mounted to the circuit, board 50. The mating end 76 defines a socket for receiving the inner conductor 28 (shown in FIG. 1) of the mating connector 14.

Figure 3:
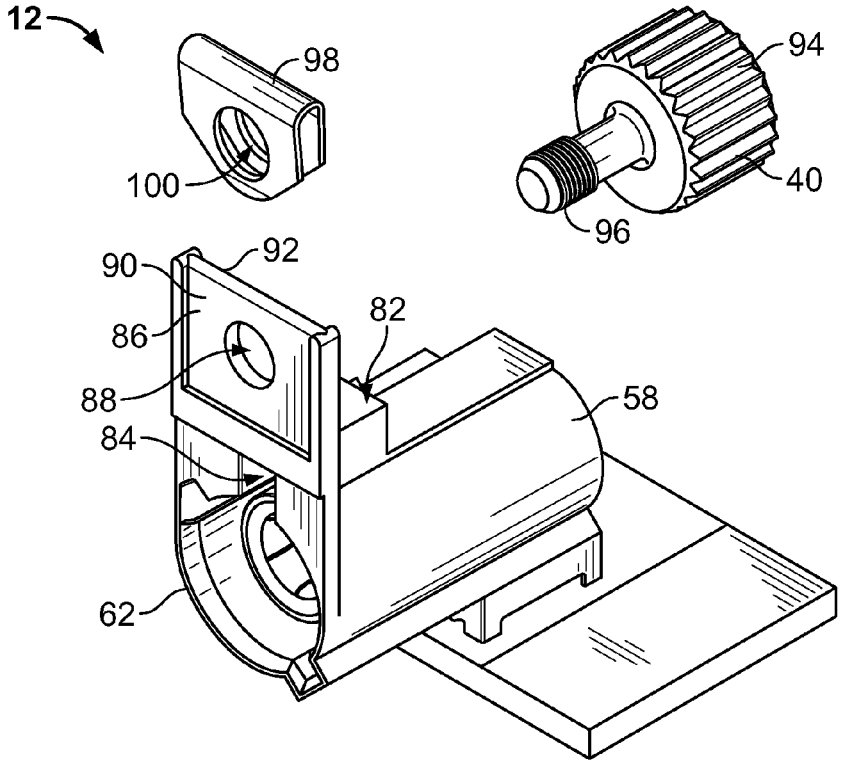
FIG. 3 is an exploded perspective view of the connector assembly shown in FIG. 1.

FIG. 3 is ah exploded perspective view of the connector assembly 12 illustrating the fastener 40 and a retainer clip 98. The outer body 58 includes a latching element 82 for mating with the mating connector 14. The latching element 82 includes an opening 84 at the mating end 62. The outer body 58 includes a flange 86 proximate to the mating end 62. Optionally, the flange 86, may be positioned at the mating end 62. The flange 86 includes an opening 88 therethrough that receives the fastener 40. The flange 86 extends from the outer body 58 perpendicular to the mating axis 68 (shown in FIG. 2). The flange 86 includes a front side 90 and rear side 92. The front side 90 defines a device mounting surface configured to face the device 16 (shown in FIG. 1) when the connector assembly 12 is installed. In the illustrated embodiment, the fastener 40 includes a head 94 and threads 96. The fastener 40 is received in the opening 38 (shown in FIG. 1) such that the threads 96 are threadably coupled to the device 16. Optionally, the connector assembly 12 includes a retainer clip 98 that extends over the flange 86 for retaining the fastener 40. The retainer clip 98 includes openings 100 that receives the fastener 40.

Figure 4:
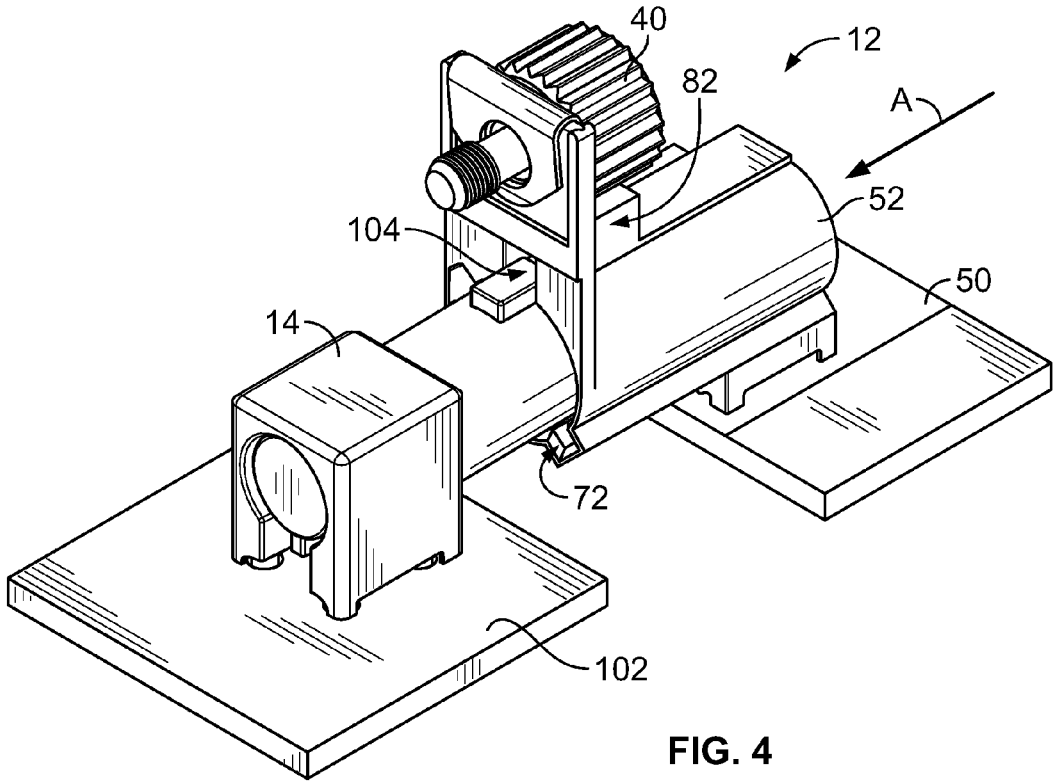
FIG. 4 illustrates the connector assembly of FIG. 3 mated with a mating connector.

FIG. 4 illustrates the connector assembly 12 partially mated with the mating connector 14. FIG. 4 shows the plug connector 52 mated to the circuit board 50. The plug connector 52 is electrically and mechanically coupled to the circuit board 50. The mating connector 14 is electrically and mechanically coupled to a circuit board 102. The mating connector 14 includes a latching element 104 for mating engagement with the latching element 82 of the connector assembly 12. The latching element 104 of the mating connector 14 is represented by a catch. Other types of hatching elements may be used in alternative embodiments.

During mating, the connector assembly 12 is mated with the mating connector 14 in a mating direction, shown in FIG. 4 by an arrow A. The keying fibs 34 (shown in FIG. 1.) are received in the keying slots 72 and the latching element 104 is received in the latching element 82. The connector assembly 12 is securely coupled to the mating connector 14 by the latching elements 82, 104. The circuit board 102 is positioned internally to the device 16 (shown in FIG. 1), such as behind one of the panels 20 (shown in FIG. 1). The mating connector 14 extends at least partially external to the panel 20 for mating with the connector assembly 12. The fastener 40 is configured to be coupled to the panel 20 to secure the connector assembly 12 to the device 16. When fully mated, a circuit is formed that includes the circuit board 50, the plug connector 52, the mating connector 14 and the circuit board 102. The system 10 (shown in FIG. 1) thus includes a board-to-board connection via the connector assembly 12 and the mating connector 14. In alternative embodiments, at least one of the plug connector 12 and the mating connector 14 may be cable connectors mounted to an end of a coaxial cable.

Figure 5:
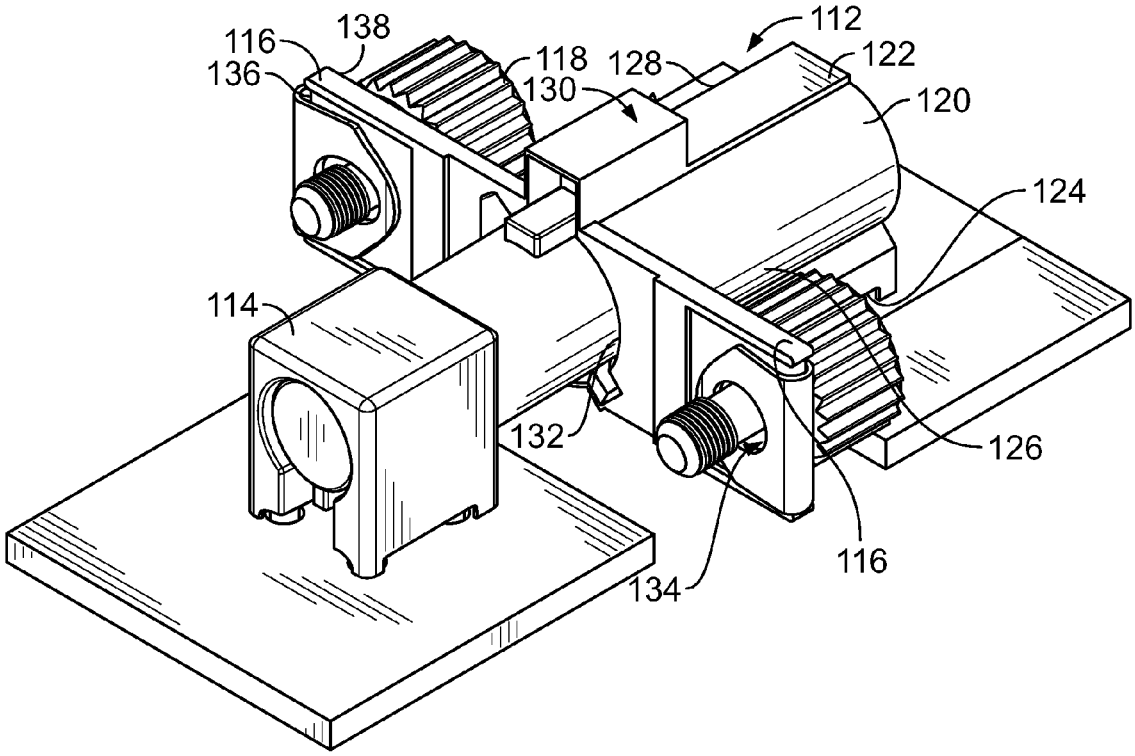
FIG. 5 illustrates ah alternative connector assembly mated with a mating connector.

FIG. 5 illustrates an alternative connector assembly 112 mated with a mating connector 114. The connector assembly 112 is similar to the connector assembly 12 (shown in FIG. 1), however the connector assembly 112 includes a pair of flanges 116. The connector assembly 112 includes a pair of fasteners 118 for securing the connector assembly 112 to a device, such as the device 16 (shown in FIG. 1). The mating connector 114 is similar to the mating connector 14 (shown in FIG. 1). Optionally, the mating connector 114 may be identical to the mating connector 14.

The connector assembly 112 includes an outer body 120. Optionally, the outer body 120 may be an outer conductor of the connector assembly 112. The connector assembly 112 also includes an inner conductor (not shown). The outer body 120 has a top 122, a bottom 124, and opposed sides 126, 128. A latching element 130 extends from the top, 122 of the outer body 120. The latching element 130 may be similar to a latching element 82 (shown in FIG. 3).

The flanges 116 extend from the opposed sides 126, 128 of the outer body 120. Optionally, the flanges 116 may extend from the outer body 120 proximate to a mating end 132 of the outer body 120. The flanges 116 may be positioned at the mating end 132. Each flange 116 includes an opening, 134 therethrough that receive fasteners 118. The fasteners 118 engage the openings 134 arid/or the flanges 116. In an exemplary embodiment, retainer clips similar to the retainer clip 98 (shown in FIG. 3) may be provided on the flanges 116 for securing the fasteners 118. The flanges 116 include a front side 136 and a rear side 138, where the front side 136 faces the device when the connector assembly 112 is installed. The fasteners 118 are received in openings in a panel of the device, such as in a pair of openings similar to the openings 38 (shown in FIG. 1). The connector assembly 112 is thus directly coupled to the device. Optionally, the front side 136 may engage the panel of the device. Alternatively, the front side 136 may be positioned away from the panel but still face the panel of the device.

Figure 6:
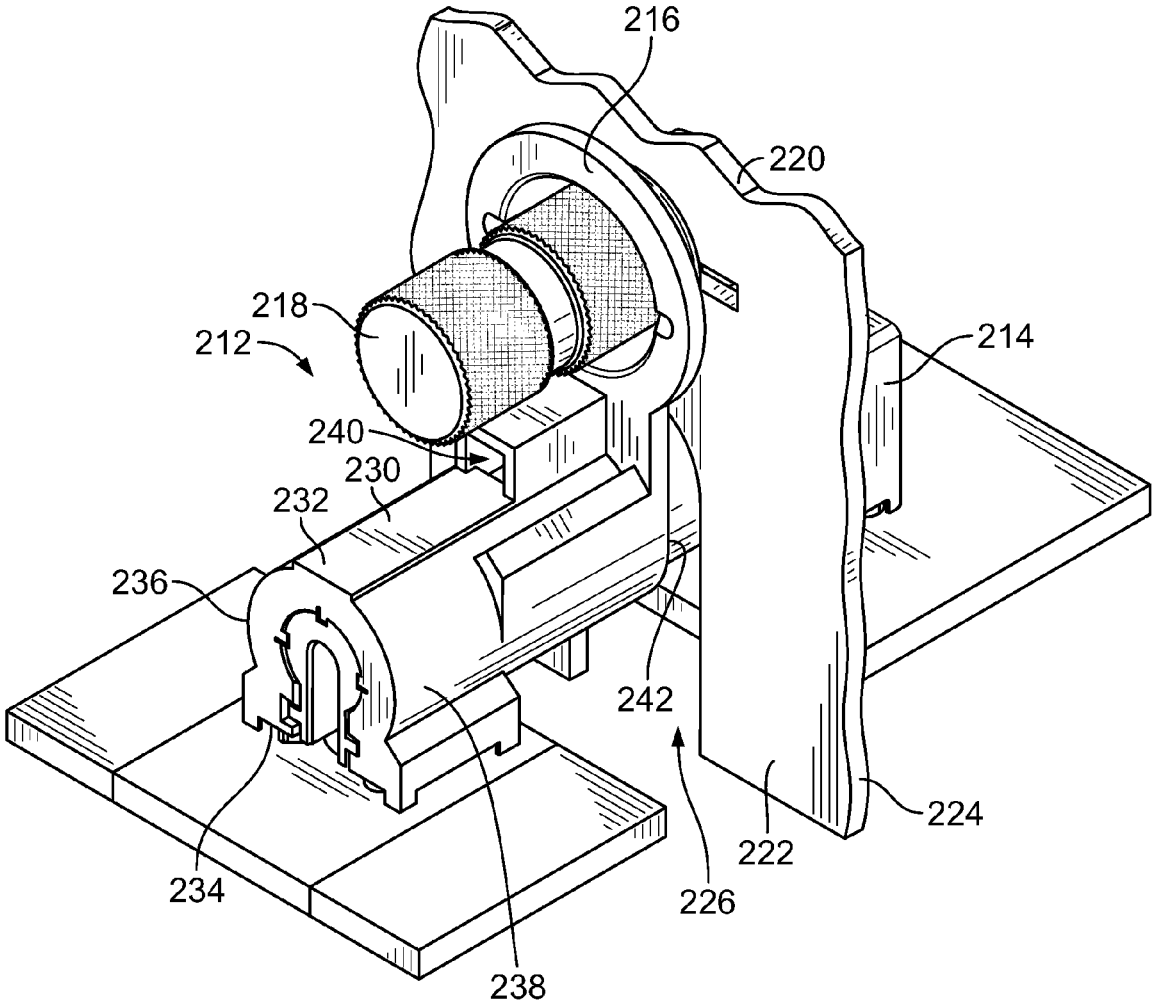
FIG. 6 is a rear perspective view of another alternative connector assembly mated with a mating connector.

FIG. 6 is a rear perspective view of another alternative connector assembly 212 mated with a mating connector 214. The connector assembly 212 is similar to the connector assembly 12 (shown in FIG. 1), however the connector assembly 212 includes a flange 216 that differs from the flange 86 (shown in FIG. 1). The connector assembly 212 includes a fastener 218 that differs from the fastener 40 for securing the connector assembly 212 to a device, such as the device 16 (shown in FIG. 1). The mating connector 214 is similar to the mating connector 14 (shown in FIG. 1). Optionally, the mating connector 214 may be identical to the mating connector 14. FIG. 6 illustrates a panel 220 of the device having a front 222 and a rear 224 that define an exterior and an interior, respectively, of the device. The mating connector 214 is mounted to, or otherwise attached to, the interior of the device 16. Optionally, at least a portion of the, mating connector 214 extends through a port 226 in the panel 220 to interface with the connector assembly 212.

The connector assembly 212 includes an outer body 230. Optionally, the outer body 230 may be an Outer conductor of the connector assembly 212. The connector assembly 212 also includes an inner conductor (not shown). The outer body 230 has a top 232, a bottom 234, and opposed sides 236, 238. A latching element 240 extends from the top 232 of the outer body 230. The latching element 240 may be similar to a latching element 82 (shown in FIG. 3). The flange 216 extends from the top 232 of the outer body 230 beyond the latching element 240. Optionally, the flange 216 may extend from the outer body 230 proximate to a mating end 242 of the outer body 230. The flange 216 may be positioned at the mating end 132.

Figure 7:
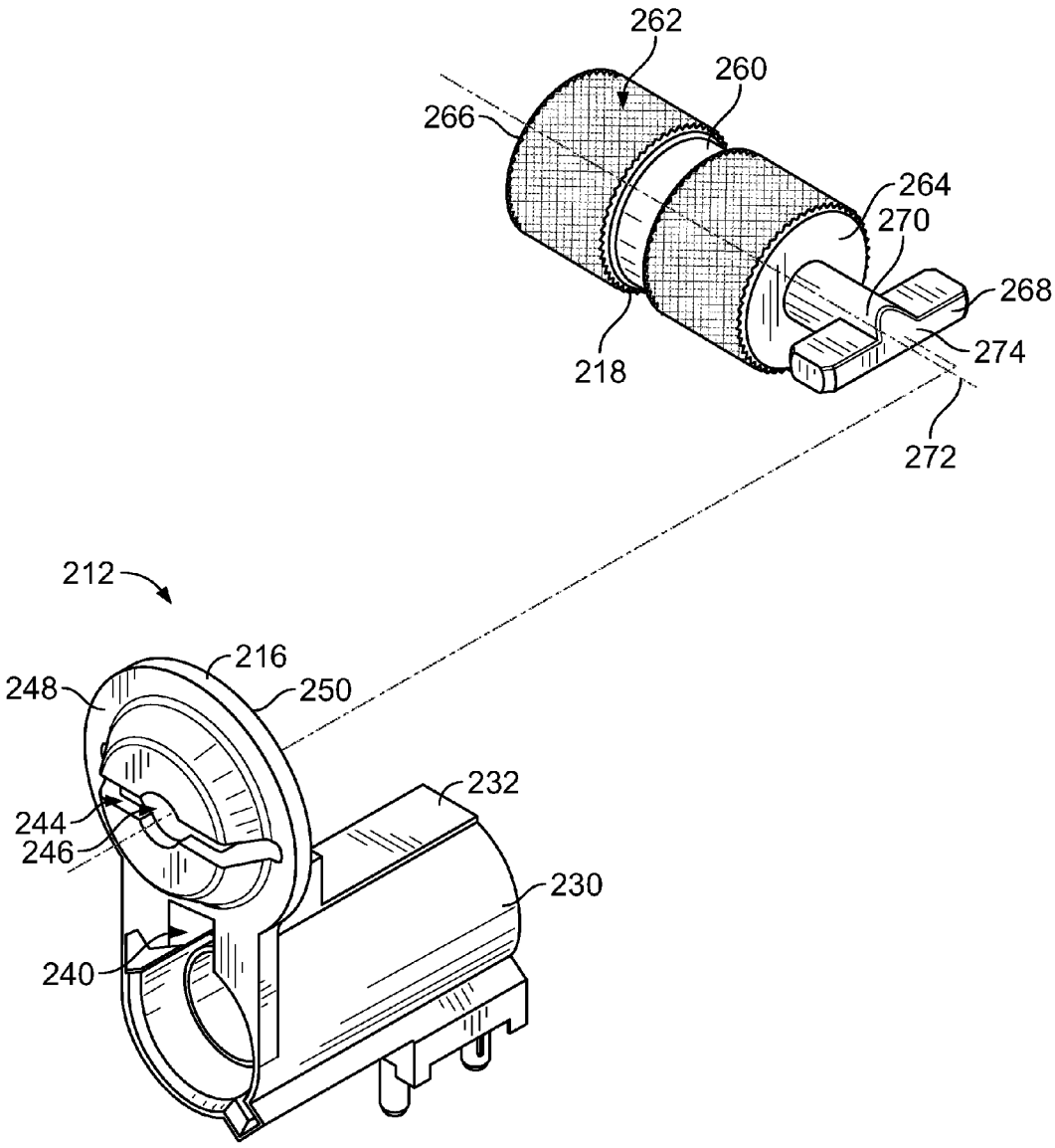
FIG. 7 is an exploded view of the connector assembly shown in FIG. 6.

FIG. 7 is an exploded view of the connector assembly 212 illustrating the outer body 230 and the fastener 218. The outer body 230 includes the flange 216 extending from the top 232. The flange 216 is positioned above the latching element 240 and includes an opening 244 therethrough. The opening 244 is an elongated slot that is elongated in the direction from side to side of the flange 216. The opening 244 includes a central hub 246 in the center of the slot. The hub 246 receives a portion of the fastener 218, as will be further described below. The flange 216 includes a front 248 and a rear 250. In the illustrated embodiment, the flange 216 is generally circularly shaped. A central portion of the flange 216 extends forwardly such that the flange 216 may be convex or bowl shaped. The convex region may flex during assembly The convex region may accommodate the fastener 218 and/or guide the fastener 218. The front side 248 is configured to face the device when the connector assembly 212 is installed. The fastener 218 extends through the opening 244 and is received in an opening 252 (shown in FIG. 8) in the panel 220 of the device.

The fastener 218 includes a cylindrical body 260 having one or more knurled sections 262, and extends between a front 264 and a rear 266. A hook 268 extends from the front 264 of the body 260. In an exemplary embodiment, the hook 268 includes a shaft, 270 extending outward from the front 264 along an axis of rotation 272. A peg 274 is provided at an end of the shaft 270 and extends transverse to the shaft 270. Optionally, the peg 274 may extend in two directions from the shaft 270 along a common axis. The hook 268 thus has a generally T-shape defined by the shaft 270 and the peg 274. Alternatively, the peg 274 may extend from the shaft 270 in only one direction, thus providing a generally L-shaped hook. Other shaped hooks are possible in alternative embodiments. The hook 268 is sized to fit through the opening 244 in the flange 216 and the opening 252 in the panel 220. For example, during assembly, the fastener 218 is aligned with the flange 216 such that the peg 274 is aligned with the opening 244. The fastener 218 is loaded through the opening 244 from the rear 250 until the peg 274 is positioned on the front side of the flange 216. Rotation of the fastener 218 thus positions the peg 274 with respect to the opening 244 such that the fastener 218 cannot be removed from the flange 216 in a rearward direction. Optionally, a washer (not shown) may be positioned between the body 260 and the flange 216.

Figure 8:
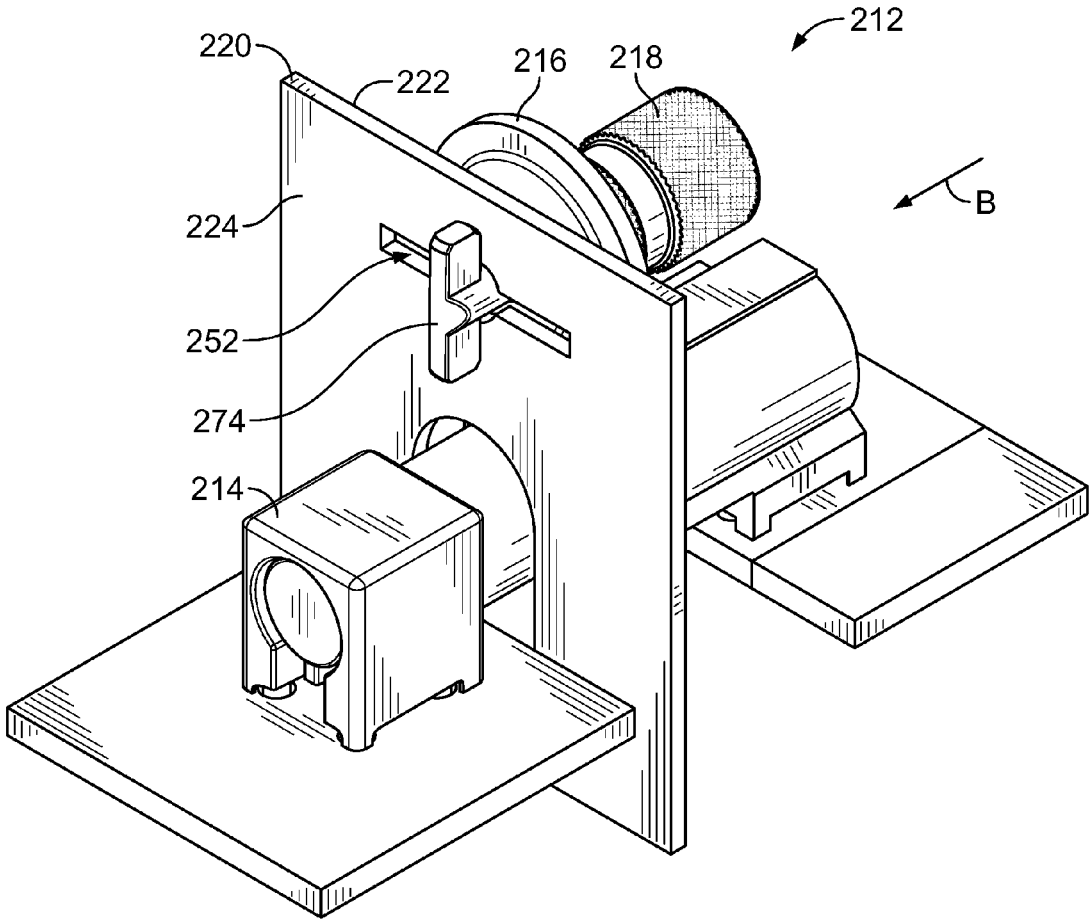
FIG. 8 is a front perspective view of the connector assembly shown in FIG. 6 mated with a mating connector.

FIG. 8 is a front, perspective view of the connector assembly 212 mated with a mating connector 214. During mating, the connector assembly 212 is loaded in the loading direction, shown in FIG. 8 by the arrow B, onto a mating end of the mating connector 214. The latching element 240 (shown in FIG. 6) engages a corresponding latching element (not shown) of the mating connector 214.

In addition to being coupled to the mating connector 214, the fastener 218 is utilized to couple the connector assembly 212 to the panel 220 of the device. In an exemplary embodiment, when the connector assembly 212 is mated with the mating connector 214 the flange 216 engages the front 222 of the panel 220. The opening 244 (shown in FIG. 7) of the flange 216 is aligned with the opening 252 that is an elongated slot. Optionally, the slot may be linear and centered with respect to the hub 246 (shown in FIG. 7) of the opening 244 when assembled. During assembly, after the connector assembly 212 is mated with the mating connector 214, the fastener 218 is loaded through the opening 244 and the opening 252 in a loading direction, generally along the arrow B. The fastener 218 is loaded until the peg 274 is positioned rearward of the rear 224 of the panel 220. Rotation of the fastener 218 thus positions the peg 274 along the rear 224 of the panel 220 such that the peg 274 engages the panel 220. The panel 220 resists removal of the fastener 218 through the opening 252. The connector assembly 212 is thus directly coupled to the device.

Figure 9:
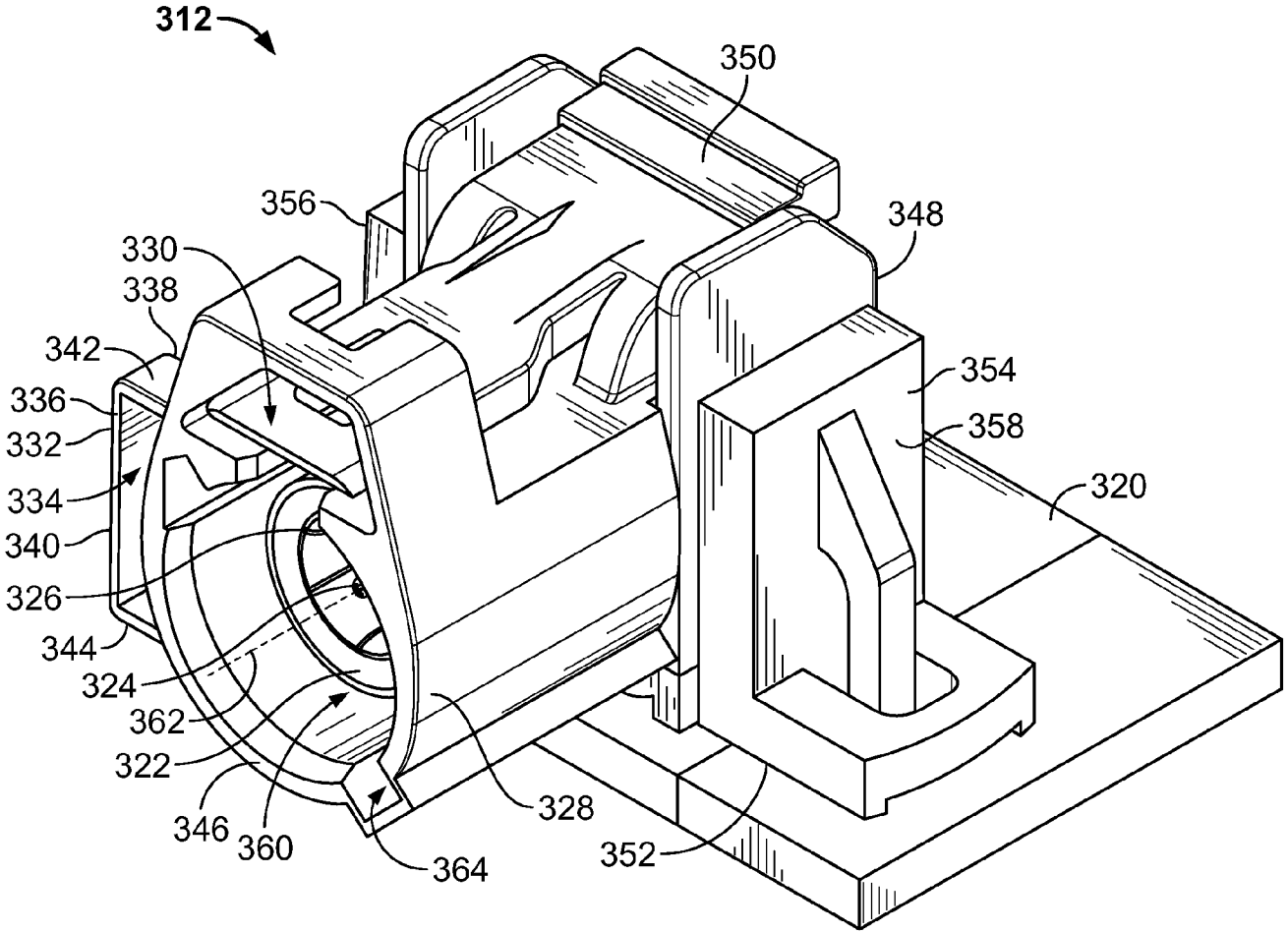
FIG. 9 is a front perspective view of yet another alternative connector assembly.

FIG. 9 is a front perspective view of yet another alternative connector assembly 312. The connector assembly 312 includes a circuit board 320 and a plug connector 322. The plug connector 322 is mechanically and electrically coupled to the circuit board 320. In the illustrated embodiment, the plug connector 322 includes an inner conductor 324, an outer conductor 326, and an outer body 328. The outer body 328 is a plastic body surrounding the outer conductor 326. The outer body 328 includes a latching element 330.

The outer body 328 also includes a flange 332 extending outward therefrom. The flange 332 includes an opening 334 extending between a front 336 and a rear 338 of the flange 332. The opening 334 has a generally rectangular cross-section and as defined by an outer wall 340, a top wall 342 and a bottom wall 344. The outer body 328 includes a mating end 346 and an opposite rear end of 348. The outer body 328 has a top 350 a bottom 352 and opposed sides 354, 356. Supports 358 may be provided on the sides 354, 356 of the outer body 328 to secure the outer body 328 to the circuit board. The latching element 330 is positioned at the top 350 and the flange 332 is positioned at the side 356. Optionally, the front 336 of the flange 332 is recessed from the mating end 346. Alternatively, the front 336 of the flange 332 may be flush with the mating end 346 or may extend external to the mating end 346. The bottom 352 of the outer body 328 is mounted to the circuit board 320.

The outer body 328 includes a mating cavity 360 extending along the mating axis 362. The outer conductor 326 is received in the mating cavity 360 and the inner conductor 324 is also received in the mating cavity 360. Optionally, the inner conductor 324 defines a center contact extending along the mating axis 362. The outer body 328 includes one or more keying slots 364.

Figure 10:
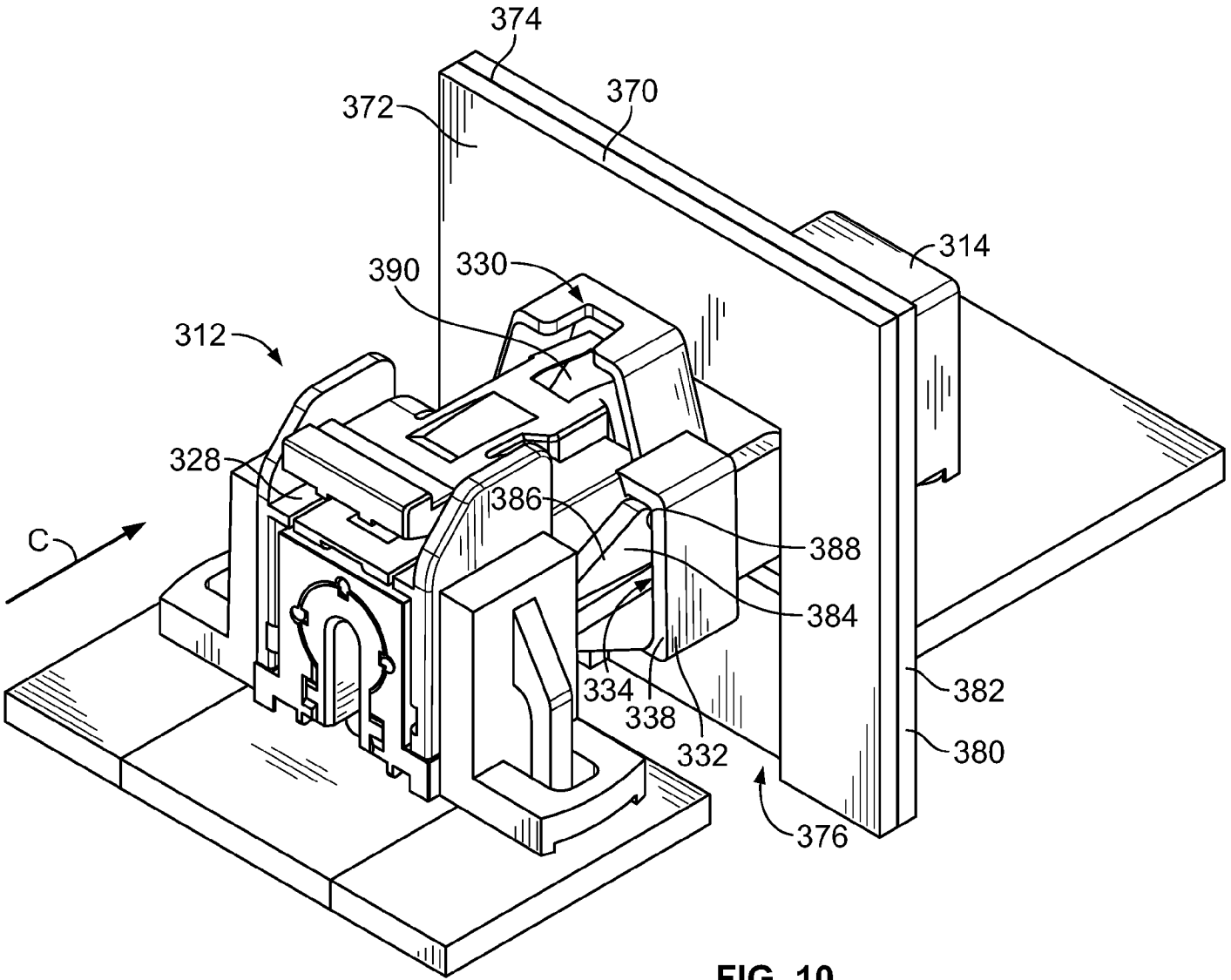
FIG. 10 is a rear perspective view of the connector assembly shown in FIG. 9 mated with a mating connector.

FIG. 10 is a rear perspective view of the connector assembly 312 mated with a mating connector 314. The mating connector 314 is similar to the mating connector 14 (shown in FIG. 1). Optionally, the mating connector 314 maybe identical to the mating connector 14. FIG. 10 illustrates a panel 370 of the device that includes a front 372 and a rear 374 that define an exterior and an interior, respectively, of the device. The mating connector 314 is mounted to, or otherwise attached to, the interior of the device 16. Optionally, at least a portion of the mating connector 314 extends through a port 376 in the panel 370 to interface with the connector assembly 312.

In an exemplary embodiment, a fastener 380 is provided. The fastener 380 includes a plate 382 and a hook 384 extending from the plate 382. The plate 382 is generally internally mounted with respect to the device and is positioned along the interior of the panel 370 and extends along the rear 374. The hook 384 extends through the port 376 and is positioned exterior of the device. The hook 384 includes a mating end 386 that is configured to be received in the opening 334 of the flange 332. Optionally, the mating end 386 may be represented by a compliant split pin. The hook 384 includes latching surfaces 388 that engage the flange 332. For example, the latching surfaces 388 engage the rear 338 of the flange 332 when the connector assembly 312 is mated with the mating connector 314 (see also FIG. 11). In an alternative embodiment the fastener 380 may be integral with the panel 370. For example, the hook 384 may be formed integral with the panel 270 and extend from an edge of the port 376 in the panel 370.

During assembly, the connector assembly 312 is aligned with the mating connector 314 and is loaded in a loading direction, shown by the arrow C. During loading, the mating connector 314 is received in the mating cavity 360 (shown in FIG. 9) of the outer body 328. When mated, the latching element 330 engages a corresponding latching element 390 of the mating connector 314. Optionally, the latching element 390 may be represented by a catch. During mating with the mating connector 314, the fastener 380 is simultaneously loaded through the opening 334 of the flange 332. Once assembled, the fastener 380 secures the connector assembly 312 to the device.

Figure 11:
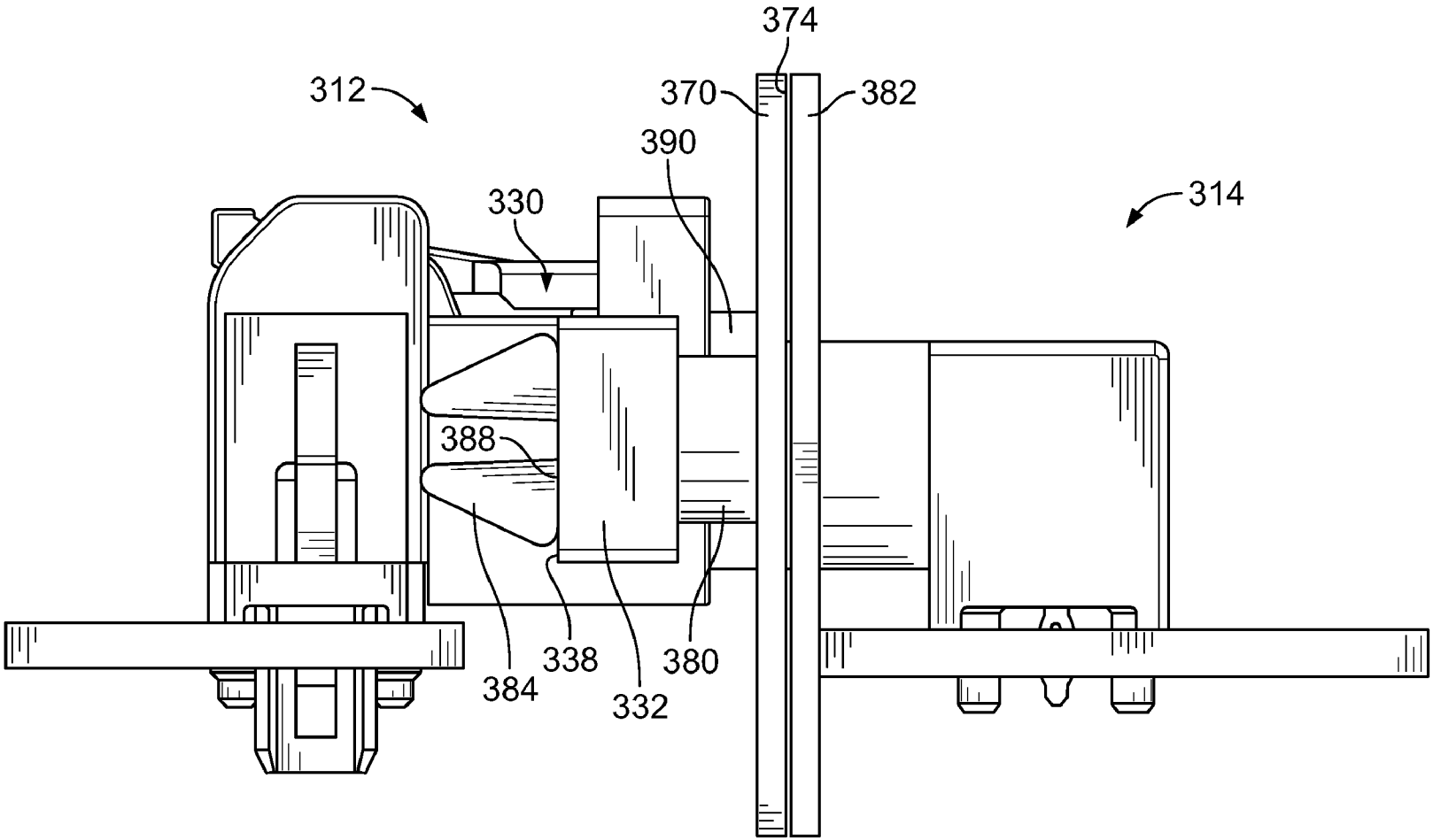
FIG. 11 is a side view of the connector assembly mated with the mating connector.

FIG. 11 is a side view of the connector assembly 312 mated with the mating connector 314. FIG. 11 shows the plate 382 of the fastener 380 on the rear 374 of the panel 370. The hook 384, which is flexible and compress as the hook 384 is passed through the flange 332, is positioned forward of the panel 370 and extends through the flange 332. The hook 384 is biased outward once the hook 384 passes through the flange 332 to latch to the flange 332. For example, the latching surfaces 388 engage the rear 338 of the flange 332. FIG. 11 also illustrates the latching element 390 of the mating connector 314 received in the latching element 330 of the connector assembly 312.

A connector assembly is thus provided that may be manufactured and/or assembled in a cost effective and reliable manner. Embodiments of the connector assembly include an outer body having a latching element configured to connect the connector assembly to the mating connector. The outer body also includes a flange extending outward therefrom. A fastener is used to couple the connector assembly directly to the device that houses the mating connector. The fastener engages the flange arid engages a panel of the device. Optionally the flange and the wall both include openings, where the fastener extends through the opening's to secure, the connector assembly to the device. By connecting the connector assembly directly to the device, the connector assembly may be securely coupled to the mating connector. The fastener operates as a secondary securing feature to securely couple the connector assembly to the mating connector. In an exemplary embodiment, the connector assembly defines an RF antenna connected to a jack of the device.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit arid scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly for mounting to a panel of a device having a mating connector securely attached to the device, the connector assembly comprising:

an inner conductor and an outer conductor coaxially aligned with one another with a dielectric body disposed between the inner and outer conductors, the outer conductor circumferentially surrounding the inner conductor and dielectric body, the inner and outer conductors defining a mating interface for mating with the mating connector;

an outer body having a latching element configured to couple to the mating connector, the outer body having a flange extending from the outer body, the flange being configured to face the device when the connector assembly is mated with the mating connector; and a fastener separately provided from the outer body, the fastener engaging the flange and the fastener being configured to engage the device to securely couple the outer body to the device.

2. The connector assembly of claim 1, wherein the flange is configured to engage an external portion of the panel of the device, and wherein the fastener is configured to engage the panel of the device.

3. The connector assembly of claim 1, wherein the panel of the device includes a front, a rear and an elongated slot, the flange includes an opening and the fastener includes a hook extending from a front of the fastener, the hook passes through the opening and is configured to pass through the slot to engage the rear of the panel of the device when the fastener is moved to a locking position.

4. The connector assembly of claim 1, wherein the panel of the device includes a front and a rear, the flange having an opening, the fastener having a hook, wherein the fastener is configured to be held against the rear of the panel of the device and extend beyond the front of the panel of the device through the opening of the flange, the hook engaging the flange to couple the outer body to the device.

5. The connector assembly of claim 1, wherein the panel of the device includes a front, a rear, and an opening therethrough, a mating portion of the mating connector is positioned behind the rear and extends through the opening to be exposed beyond the front, the inner and outer conductors mate with the mating portion of the mating connector, the flange being positioned proximate to the front of the panel and the fastener connects the flange to the panel.

6. The connector assembly of claim 1, wherein the outer body is a plastic outer body surrounding the outer conductor.

7. The connector assembly of claim 1, wherein the outer body includes a mating end, the latching element and the flange extend from the outer body proximate to the mating end.

8. The connector assembly of claim 1, wherein the flange includes an opening, the fastener extends through the opening to couple the outer body to the device.

9. The connector assembly of claim 1, wherein the mating connector is an SMB jack connector with a FAKRA mating interface having a catch, the inner conductor and the outer conductor are configured to mate with the jack connector, and the latching element receives the catch to couple the outer body to the jack connector.

10. The connector assembly of claim 1, wherein the fastener includes a screw having a head and threads, at least one of the head and the threads engage the flange, the threads are configured to engage the device.

11. An RF connector assembly comprising:

a circuit board defining an RF antenna;

a coaxial plug connector electrically and mechanically coupled to the circuit board, the plug connector being matable with a coaxial jack connector securely attached to a device, the plug connector comprising:

an outer body having a mating cavity configured to receive the jack connector along a mating axis, the outer body having a latching element configured to couple to the jack connector, and the outer body having a flange extending from the outer body, the flange having an opening;

a center contact received in the cavity and extending along the mating axis, the center contact having a mating end for mating with the jack connector and a mounting end coupled to the circuit board; and an outer conductor coaxially aligned with, and circumferentially surrounding, the center conductor; and a fastener received in the opening of the flange, the fastener being configured to engage the device to securely couple the outer body to the device.

12. The connector assembly of claim 11, wherein the fastener includes a screw having a head and threads, at least one of the head and the threads engage the flange, the threads are configured to engage the device.

13. The connector assembly of claim 11, wherein the device includes a panel having a front, rear and an elongated slot, the flange includes an opening and the fastener includes a hook extending from a front of the fastener, the hook passes through the opening and is configured to pass through the slot to engage the rear of the panel of the device when the fastener is moved to a locking position.

14. The connector assembly of claim 11, wherein the device includes a panel having a front and a rear, the flange includes an opening, and the fastener includes a hook, wherein the fastener is configured to be held against the rear of the panel of the device and extend beyond the front of the panel of the device through the opening of the flange, the hook engages the flange to couple the outer body to the device.

15. The connector assembly of claim 11, wherein the jack connector is mounted internally within the device and is exposed through a port in a panel of the device, a mating portion of the jack connector extends through the port beyond the panel, the plug connector is mated to the jack connector such that the flange is positioned proximate to the panel, the fastener engages the panel of the device proximate to the port in the panel.

16. The connector assembly of claim 11, wherein the jack connector includes a keying rib extending outward from the jack connector, the outer body includes a keying slot extending along the mating cavity, the keying slot is configured to receive the keying rib of the jack connector to orient the outer body with respect to the jack connector.

17. An RF connector system for a device, the RF connector system comprising:

a jack connector being configured to be mounted internally within the device proximate a port in a panel of the device, the jack connector having an inner conductor and an outer conductor coaxially aligned with one another with a dielectric body disposed between the inner and outer conductors, the outer conductor circumferentially surrounding the inner conductor and dielectric body, the inner and outer conductors defining a mating interface, the jack connector having a latching element;

a plug connector having a center contact coupled to the inner conductor of the jack connector, the plug connector having an outer body including a latching element configured to latch to the latching element of the jack connector, the outer body includes a flange extending from the outer body; and a fastener engaging the flange and being configured to engage the panel of the device proximate to the port to securely couple the outer body to the device.

18. The connector assembly of claim 17, wherein the fastener includes a screw having a head and threads, at least one of the head and the threads engage the flange, the threads are configured to engage the device.

19. The connector assembly of claim 17, wherein the device includes a panel having a front, rear and an elongated slot, the flange includes an opening and the fastener includes a hook extending from a front of the fastener, the hook passes through the opening and is configured to pass through the slot to engage the rear of the panel of the device when the fastener is moved to a locking position.

20. The connector assembly of claim 17, wherein the device includes a panel having a front and a rear, the flange includes an opening, and the fastener includes a hook, wherein the fastener is configured to be held against the rear of the panel of the device and extend beyond the front of the panel of the device through the opening of the flange, the hook engages the flange to couple the outer body to the device.

* * * * *